US005206979A

United States Patent [19]

Campbell

[11] Patent Number: 5,206,979

[45] Date of Patent: May 4, 1993

[54] ROLLER FOR SPECIALTY PAINT FINISHES

[76] Inventor: David W. Campbell, 52021 D.W. Seaton, New Baltimore, Mich. 48047

[21] Appl. No.: 864,503

[22] Filed: Apr. 7, 1992

[51] Int. Cl.[5] ..... B05C 1/08; B21B 13/02

[52] U.S. Cl. ..... 492/13; 15/230.11; 492/19; 492/48

[58] Field of Search ..... 29/110.5, 116.1, 120, 29/123, 129, 131; 15/230.11, 230.16; D4/122, 123

[56] References Cited

U.S. PATENT DOCUMENTS

| | | | |
|---|---|---|---|
| 2,464,040 | 3/1949 | Huebner . | |
| 2,467,010 | 4/1949 | Colen . | |
| 2,584,724 | 2/1952 | Mattie | 29/131 X |
| 2,645,845 | 7/1953 | Vengris | 29/116.1 |
| 2,647,300 | 8/1953 | Thomas et al. | 29/120 |
| 2,751,618 | 6/1956 | Pruitt | 29/116.1 |
| 3,030,696 | 4/1962 | Serwer . | |
| 3,926,701 | 12/1975 | Nishiwaki | 29/120 X |
| 3,955,260 | 5/1976 | Sherden . | |
| 4,191,792 | 3/1980 | Janssen | 29/120 X |
| 4,257,140 | 3/1981 | Downing . | |
| 4,930,179 | 6/1990 | Wright et al. . | |

OTHER PUBLICATIONS

"How to Create Fantasy Finishes with Flair & Imagination", Benjamin Moore & Co., Newark, N.J., Dated Jan. 1991.

*Primary Examiner*—Timothy V. Eley
*Assistant Examiner*—C. Richard Martin
*Attorney, Agent, or Firm*—Peter D. Keefe

[57] ABSTRACT

A specialty paint finish roller composed of a substantially conventional roller handle assembly having an axle, a roller tube, a pair of bushings for rotatably interfacing with the at least one axle of the roller handle assembly, and a disposable, generally cylindrically shaped rag component twisted around the roller tube, tucked into the axial cavity of the roller tube at either end thereof and secured thereto by a press fit of the bushings with respect to the axial cavity of the roller tube. The rag component is more or less twisted with respect to the roller tube. A specialty finish is provided by the specialty paint finish roller using either the positive application method or the negative application method. Rag components are easily replaceable during the job in order to achieve a maximally artistic result, as could formerly only be achievable using hands-on rag rolling techniques.

10 Claims, 2 Drawing Sheets

ROLLER FOR SPECIALTY PAINT FINISHES

BACKGROUND OF THE INVENTION

1. Field of the invention

The present invention relates to the production of specialty paint finishes, particularly those produced on interior walls by "rag rolling" and various other allied techniques, each of which involving considerable labor and mess. More particularly, the present invention relates to a paint roller which is structurally configured to achieve a specialty paint finish of the aforesaid class without undue effort or mess.

2. Description of the Prior Art

Specialty finishes, especially those applied to interior walls of dwellings, office and other buildings, are becoming increasingly popular. Specialty finishes afford extremely interesting visual effects that simply painted walls cannot match. Indeed, the visual effects achievable rival those of vastly more expensive wall papers.

Conventionally, specialty finishes involve a two step process: uniform application of a base coat of one paint and selective application of a top coat of one or more other paints over the base coat. There are two methods used for the application of the top coat: a negative application method, whereby the top coat is selectively removed after it has been uniformly applied over the base coat, and a positive application method, whereby the top coat is selectively applied over the base coat.

In either application method of the top coat, various tools are conventionally used. These include, sponges, cloth (such as loosely rolled cheese cloth, paint brushes, short nap paint rollers, and brushes (such as a whisk broom). Each of these tools are hand held and hand manipulated while paint laden; therefore, gloves are required and mess is inevitable.

One of the most exciting specialty finishes is that produced by a technique known as "rag rolling". Rag rolling involves the use of a piece of cloth (the "rag") to apply the finish of the top coat over the base coat by either of the positive or negative application methods after the base coat has dried. In the positive application method, a rag is dipped in the paint, twisted loosely, then rolled by hand carefully down the wall from top toward bottom. In the negative application method, the top coat is applied to a section of the wall, then a loosely twisted rag is hand rolled over the section so as to remove part of the top coat. In either application method, unique and interesting patterns emerge from movement of the rag.

A further discussion of conventional specialty finish techniques is contained in a publication "How to Create Fantasy Finishes with Flair & Imagination", available through Benjamin Moore Paints, dated January of 1991.

As can be gathered from the foregoing description of rag rolling, the process is quite messy, laborious and time consuming. Direct hand manipulation of paint laden tools being thusly undesirable, the prior art has addressed some attention to solving this problem. In the closest known prior art, U.S. Pat. No. 4,930,179 to Wright et al, dated Jun. 5, 1990, discloses a paint roller having a roller portion which allegedly produces rag rolling effects. The roller portion is provided on its periphery with a plurality of axially extending twin flap members of chamois leather material, one of the flaps of each twin flap member being longer than the other. While this device may provide some assistance to those persons wishing to engage in rag rolling without its attendant labors and distress, still there remain considerable disadvantages. The device of Wright et al is not well suited to either positive or negative top coat application methods: in the case of the positive application method, the twin flap members cannot hold sufficient paint to do the job; in the case of the negative application method, the twin flap members cannot absorb enough paint to do the job. Indeed, with regard to the negative application method, in order to ensure a proper effect, it is the conventional practice to use very absorbent cloths which are discarded as soon as they become excessively paint burdened; clearly the device of Wright et al is deficient with respect to absorbency and with respect to periodic cloth replacement during a job.

Accordingly, what is needed is a device which proves a specialty paint finish without the undue effort and mess attendant with prior art techniques and devices.

SUMMARY OF THE INVENTION

The present invention is a paint roller which is structured to provide a specialty finish with respect to a top coat of paint, wherein a visual result similar to that provided by hands-on rag rolling methods is easily and quickly achieved without generation of mess.

The specialty paint finish roller is composed of a substantially conventional roller handle assembly having an axle, a roller tube, a pair of bushings for rotatably interfacing with the at least one axle of the roller handle assembly, and a disposable, generally cylindrically shaped rage component twisted around the roller tube, tucked into the axial cavity of the roller tube at either end thereof and secured thereto by a press fit of the bushings with respect to the axial cavity of the roller tube.

In operation, the rag component may be more or less twisted with respect to the roller tube so as to provide a preselected amount of visual effect on the top coat. A specialty finish is provided by the specialty paint finish roller using either the positive application method or the negative application method. Rag components are easily replaceable during the job in order to achieve a maximally artistic result, as could formerly only be achievable using hands-on rag rolling techniques.

Accordingly, it is an object of the present invention to provide a specialty paint finish roller which facilitates application of specialty finishes without mess or undue labors.

It is another object of the present invention to provide a specialty paint finish roller which utilizes replaceable rag components which are selectively twistable to achieve a desired specialty finish similar to that afforded by hands-on rag rolling techniques.

It is an additional object of the present invention to provide a specialty paint finish roller which utilizes replaceable rag components which are selectively twistable to achieve a desired specialty finish similar to that afforded by hands-on rag rolling techniques, wherein the rag component is easily changed.

It is a further object of the present invention to provide a specialty paint finish roller which utilizes replaceable rag components which are selectively twistable to achieve a desired specialty finish similar to that afforded by hands-on rag rolling techniques, wherein operation thereof may involve either the positive application method or the negative application method.

These, and additional objects, advantages, features and benefits of the present invention will become apparent from the following specification.

DETAILED DESCRIPTION OF THE PREFERRED EMBODIMENT

Figure 1:
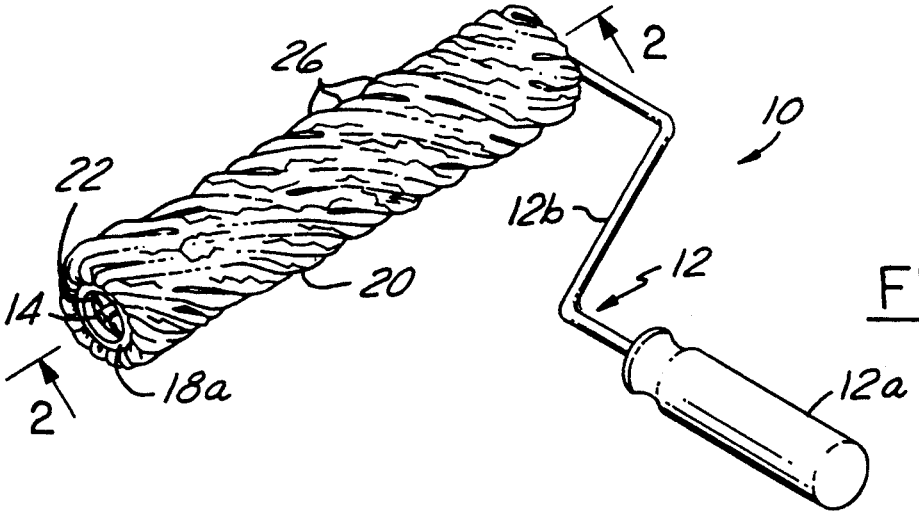
FIG. 1 is a perspective view, generally showing the specialty paint finish roller according to the present invention.

Referring now to the Drawing, FIG. 1 shows the specialty paint finish roller 10 according to the present invention. As can be discerned from FIG. 1, the specialty paint finish roller 10 is generally composed of a roller handle assembly 12 having an axle 14, a roller tube 16, a pair of bushings 18*a*, 18*b* for rotatably interfacing with the axle of the roller handle assembly, and a disposable, generally cylindrically shaped rag component 20 that is twisted around the roller tube, tucked into the axial cavity 16*a* (see FIG. 2) of the roller tube at either end thereof and secured thereto by a press fit of the bushings with respect to the axial cavity of the roller tube. The specialty paint finish roller 10 is operable either according to the positive application method or the negative application method, as will be detailed hereinbelow. Rag components 20 are easily replaceable during a job in order to achieve a maximally artistic result, as could formerly only be achievable using hands-on rag rolling techniques. The structure and function of the specialty paint finish roller 10 will be detailed with greater specificity in the following description.

The roller handle assembly 12 is of a substantially conventional structure of the type used for conventional paint rollers. The roller assembly 12 includes a handle 12*a* and a connector member 12*b* for connecting the axle 14 transversely with respect to the handle 12*a*, as depicted in FIG. 1. It is preferred for the handle 12*a* to be constructed of plastic and for the connector member 12*b* to be constructed of a metallic rod coated with an anti-corrosion plating. It is preferred for the axle 14 to be integral with the connection member 12*b*; the axle, therefore, is constructed of the metallic rod of the connector member 12*b*. The connector member 12*b* is bent so that the handle 12*a* is located transversely with respect to the axle 14 substantially mid-way along the axle, as is the well known mode of construction of conventional paint rollers.

Figure 2:
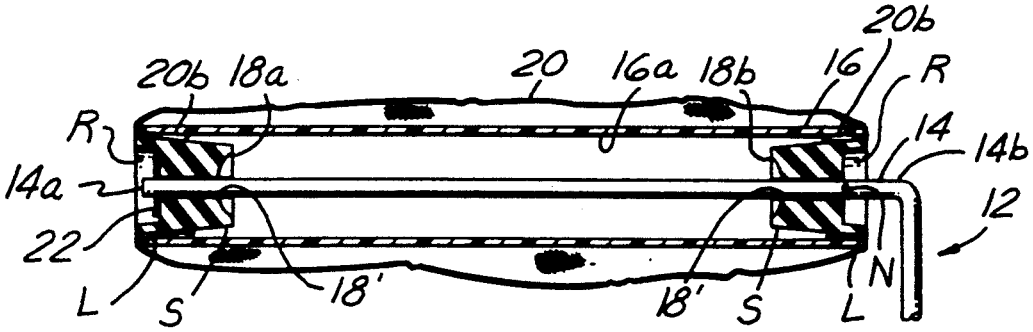
FIG. 2 is a partly sectional fragmentary side view of the specialty paint finish roller according to the present invention, shown along lines 2—2 in FIG. 1.

Referring now in particular to FIG. 2, it is seen that the roller tube 16 is rotatably supported with respect to the axle 14 by operation of the bushings 18*a* and 18*b*. The roller tube 16 is in the form of a cylindrical shell that is open at each end, and is constructed of any light, strong, durable matter such as plastic. The bushings 18*a*, 18*b* are of frustoconical shape and are preferred to be constructed of a semi-rigid resilient mater such as a hard rubber. The bushings 18*a*, 18*b* are each provided with an axle hole 18' through which the axle passes. The smaller cross-section end S of each of the bushings 18*a*, 18*b* is inserted firstly into the axial cavity 16*a* of the roller tube 16, as shown in FIG. 2, and operatively in FIGS. 3 and 4. The larger cross-section end L of each of the bushings 18*a*, 18*b* is less than the cross-section of the axial cavity 16*a*, so that the rag component 20 may be inserted therebetween, as will become clear momently.

The rag component 20 is composed of an absorbent cloth-like material 20*a*, such as a fabric sheet, or a chamois cloth. The cloth-like material is seamed so as to generally form an open ended cylindrical shape that is longer than he length of the roller tube 16 and having a cross-section substantially larger than that of the cross-section of the roller tube.

Figure 3:
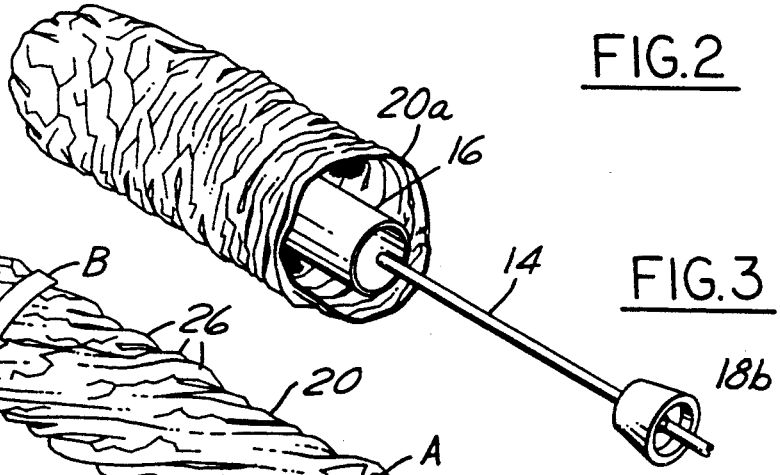
FIGS. 3 through 5 show progressive stages in the installation and preparation of the rag component with respect to the specialty paint finish roller.
Figure 4:
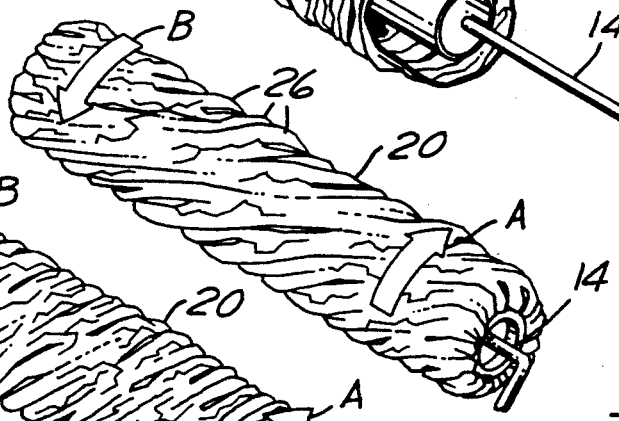
Figure 5:
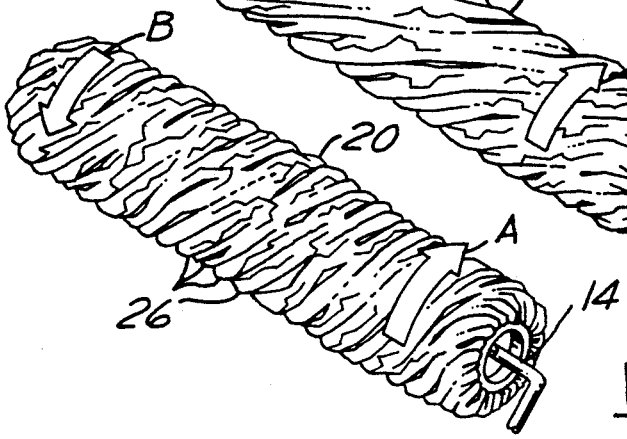

Assembly will be detailed with reference being had to FIGS. 2 through 5. As shown in FIG. 3, the rag component 20 is slipped over the roller tube. The ends of the cloth-like material 20*a* are then tucked into the axial cavity 16*a* at each end of the roller tube 16. The bushings 18*a*, 18*b* are then inserted into the axial cavity 16*a* at respective ends of the roller tube 16 until the bushings are at least substantially inserted thereinto (and preferably entirely inserted thereinto), as shown in FIG. 2. In this position, the larger end L of the bushings 18*a*, 18*b* presses resiliently against the tucked portions 20*b* of the rag component 20 and the axial cavity 16*a* so as to secure the rag component to the roller tube 16, as well as secure the bushings with respect to the roller tube. Adjacent the captive end 14*b* of the axle is a retaining nib N which holds the bushing 18*b* from sliding any further along the axle, and a selectively removable retainer, such as a self tapping nut 22, is placed on the free end 14*a* of the axle 14 to firmly prevent the other bushing 18*a* from sliding off the axle. It is to be understood that the axle holes 18' in the bushings 18*a*, 18*b* permit the roller tube and its associated rag component 20 to rotate with respect to the axle 14 in a manner not unlike that of a conventional paint roller. A recess R may be provided in the larger cross-section end L of the bushings so as to receive the self tapping nut 22, thereby eliminating its possible interference when the specialty paint finish roller 10 is rolled along a corner. The cloth-like material 20*a* of the rag component 20 is now twisted along arrows A or B to achieve more or less twist therein with respect to the roller tube 16, as shown in FIGS. 4 and 5. Twisting produces a plurality of twist folds 26 in the cloth-like material 20*a*.

Operation will now be detailed, with reference being directed to the Drawing, generally. The rag component is attached to the roller tube and then twisted relative thereto in the manner hereinabove described. In the positive application method of operation, the rag component is rolled in a pan containing the top coat and then rolled over the previously applied and dried base coat so as to selectively apply top coat thereto, with the user directing the operation by grasping the handle. In the negative application method of application, the top coat is applied over the base coat to a section of surface being decorated by a conventional means; thereupon the rag component is rolled over the top coated section so as to selectively remove top coat therefrom with the user directing the operation by grasping the handle. In either application method of operation, the rag component may be easily removed by unscrewing the self tapping nut 22, pushing out the axle from the bushings, removing the bushings from the axial cavity (optionally with the assistance of the axle as a pushing tool), disposing of the rag component, and then reinstalling of a new rag component as outlined hereinabove. This is particularly useful with regard to the negative application method of operation, which best operates with a dry cloth-like material, as it is then maximally absorbent, and thereby better able to remove top coat.

Figure 6:
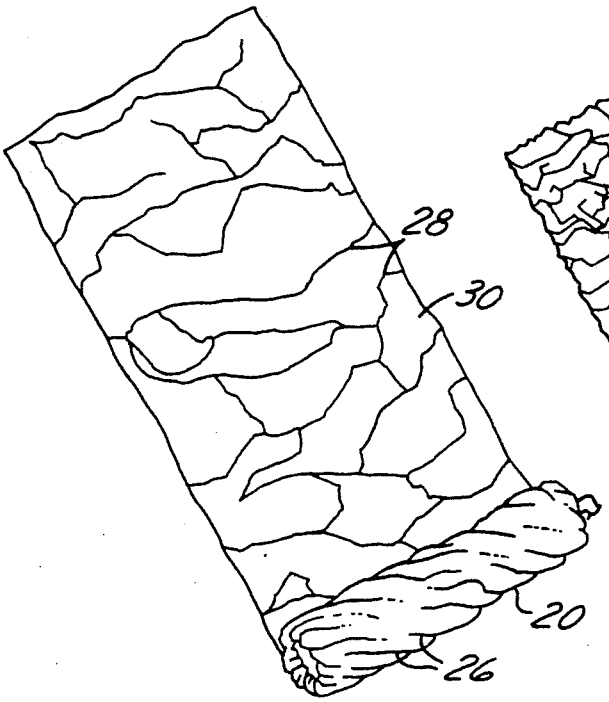
FIGS. 6 and 7 finishes obtainable by preselected amounts of twisting of the rag component with respect to the roller tube.
Figure 7:
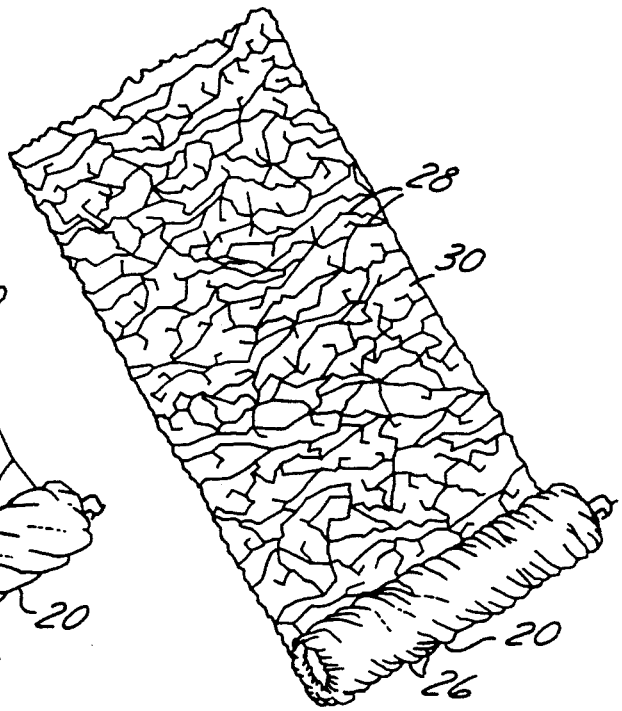

In either application method, as can be discerned from FIGS. 6 and 7, a tightly twisted rag component 20 will generally provide a more complex pattern 28 in the top coat 30, as shown in FIG. 7, than would be provided by a less tightly twisted rag component, as shown in FIG. 6. Thus, the amount of twisting and the number of twist folds 26 based on the relate cross-sections of the rag component with respect to the roller tube will provide a variety of user selectable patterns that are similar to that produced by hand-held rag rolling techniques.

To those skilled in the art to which this invention appertains, the above described preferred embodiment may be subject to change or modification. For instance, while the rag component is referred to as being of a substantially cylindrical shape, this is to be loosely interpreted to include other shapes, such as an elliptical cross-section. Further, the term "rag component" as used herein has expansive meaning to include other materials besides the preferred cloth-like absorbent material that is indicated hereinabove with respect to the preferred embodiment. That is, the rag component includes other absorbent materials, such as a foam sheet. Still further, the rag component includes other materials besides absorbent materials, such as plastic or aluminum foils, which, while not absorbent, produce interesting top coat effects when twisted on the roller tube and then rolled in the manner generally discussed hereinabove. Such change or modification can be carried out without departing from the scope of the invention, which is intended to be led only by the scope of the appended claims.

What is claimed is:

1. A specialty paint finish roller, comprising:

a roller handle assembly comprising a handle and a connector member connected with said handle;

an axle connected with said connector member;

a roller tube having a first open end and a second open end, said roller tube having an axial cavity located between said first and second open ends;

a rag component structured to cover said roller tube, said rag component covering said roller tube, said rag component being twisted about said roller tube by said rag component being rotated in a clockwise direction adjacent said first open end of said roller tube and relatively rotated in a counterclockwise direction adjacent said second open end of said roller tube;

means for connecting said rag component to said roller tube; and bushing means for rotatably connecting said roller tube to said axle.

2. The specialty paint finish roller of claim 1, wherein said rag component is composed of an absorbent material.

3. The specialty paint finish roller of claim 2, wherein said rag component has a first cross-section and said roller tube has a second cross-section, wherein said first cross-section is greater than said second cross-section so that said rag component loosely covers said roller tube.

4. The specialty paint finish roller of claim 3, wherein said rag component has a first end and a second end, said rag component having a first length defined between said first and second ends; wherein said roller tube has a second length; wherein said first length exceeds said second length; wherein a portion of said first end of said rag component is tucked into said axial cavity at said first end of said roller tube, and a portion of said second end of said rag component is tucked into said axial cavity at said second end of said roller tube; and wherein said means for connecting comprises said bushing means resiliently pressing against said tucked portions and said axial cavity so as to retain said rag component with respect to said roller tube.

5. The specialty paint finish roller of claim 4, wherein said bushing means comprises:

a first bushing of frustoconical shape that is defined by a smaller cross-section end and a larger cross-section end, said first bushing being constructed of a semi-rigid resilient material, said first bushing having an axially located first axle hole for rotatably receiving therethrough said axle, said larger cross-section end of said first bushing being dimensioned to press against said tucked portion of said first end of said rag component and said axial cavity so as to press fit into said axial cavity at said first end of said roller tube; and a second bushing of frustoconical shape that is defined by a smaller cross-section end and a larger cross-section end, said second bushing being constructed of a semi-rigid resilient material, said second bushing having an axially located second axle hole for rotatably receiving therethrough said axle, said larger cross-section end of said second bushing being dimensioned to press against said tucked portion of said second end of said rag component and said axial cavity so as to press fit into said axial cavity at said second end of said roller tube.

6. The specialty paint finish roller of claim 5, further comprising retaining means for holding said first and second bushings on said axle.

7. The specialty paint finish roller of claim 6, wherein said retaining means comprises a selectively removable retainer means; further comprising recess means located on at least one of said first and second bushings for receiving said retainer means.

8. The specialty paint finish roller of claim 1, wherein said rag component is composed of a non-absorbent material.

9. The specialty paint finish roller of claim 8, wherein said non-absorbent material is an aluminum foil.

10. The specialty paint finish roller of claim 1, wherein said rag component is composed of a foam sheet material.

* * * * *